US010633788B2

(12) United States Patent
Brown et al.

(10) Patent No.: US 10,633,788 B2
(45) Date of Patent: Apr. 28, 2020

(54) TREATMENT OF FABRICS AND TEXTILES

(71) Applicant: NIKWAX LIMITED, Wadhurst, East Sussex (GB)

(72) Inventors: Nicholas Brown, Ticehurst (GB); David John Ellis, Burgess Hill (GB)

( * ) Notice: Subject to any disclaimer, the term of this patent is extended or adjusted under 35 U.S.C. 154(b) by 0 days.

(21) Appl. No.: 15/574,608

(22) PCT Filed: May 17, 2016

(86) PCT No.: PCT/GB2016/051413

§ 371 (c)(1),
(2) Date: Nov. 16, 2017

(87) PCT Pub. No.: WO2016/185195

PCT Pub. Date: Nov. 24, 2016

(65) Prior Publication Data

US 2018/0135241 A1 May 17, 2018

(30) Foreign Application Priority Data

May 18, 2015 (GB) ..... 1508527.7
Apr. 25, 2016 (GB) ..... 1607178.9

(51) Int. Cl.
*D06M 15/03* (2006.01)
*D06M 13/188* (2006.01)

(52) U.S. Cl.
CPC ..... *D06M 15/03* (2013.01); *D06M 13/188* (2013.01); *D06M 2200/12* (2013.01)

(58) Field of Classification Search
CPC . D06M 15/03; D06M 13/188; D06M 2200/12
See application file for complete search history.

(56) References Cited

U.S. PATENT DOCUMENTS

2002/0161116 A1* 10/2002 Yu ..... C08L 83/04 525/100
2004/0121680 A1 6/2004 Yahiaoui et al.
2009/0298367 A1* 12/2009 Lafaysse ..... C09D 183/04 442/59

FOREIGN PATENT DOCUMENTS

| | | | |
|---|---|---|---|
| CN | 104450343 | A | 3/2015 |
| CN | 104532556 | A | 4/2015 |
| EP | 2267216 | A1 | 12/2010 |
| WO | 9810134 | A1 | 3/1998 |
| WO | 2016058781 | A1 | 4/2016 |

OTHER PUBLICATIONS

Hughes et al. Physical and Functional Properties of Some Higher Alkyl Polyglucosides. Journal of the American Oil Chemists Society. vol. 47, p. 162-167, May 1970.*
International Search Report and Written Opinion for PCT/GB2016/051413 dated Jul. 25, 2016.

* cited by examiner

*Primary Examiner* — Amina S Khan
(74) *Attorney, Agent, or Firm* — Heslin Rothenberg Farley & Mesiti P.C.

(57) ABSTRACT

The invention relates to a wetting system for providing a wetting effect to a fabric or textile comprising a solution of an alkyl polyglucoside in combination with a solution of a Group 4 metal salt. The invention also relates to a process for producing a wetting or re-wetting effect on a textile or fabric comprising applying a wetting system to the fabric that comprises a solution of an alkyl polyglucoside in combination with a solution of a Group 4 metal salt and drying the fabric at a low temperature, i.e. less than 100° C.

22 Claims, No Drawings

TREATMENT OF FABRICS AND TEXTILES

CROSS REFERENCE TO RELATED APPLICATIONS

This application is a U.S. National Phase filing under 35 U.S.C. § 371 of International Application PCT/GB2016/051413, filed May 17, 2016, and published as WO 2016/185195 A1 on Nov. 24, 2016. PCT/GB2016/051413 claims priority from Great Britain application numbers 1508527.7, filed May 18, 2015, and 1607178.9, filed Apr. 25, 2016. The entire contents of each of these applications are hereby incorporated herein by reference.

TECHNICAL FIELD

The present invention relates to a novel combination of reagents for use in an improved process for applying a wetting effect to a textile or fabric and for preparing fabrics for the application of a water repellent. In particular, it relates to a novel combination of reagents that together form a wetting system that when applied to a textile or fabric and on low temperature drying of the textile continues to provide a re-wetting effect to the textile but on raising the temperature of the textile above a certain temperature the re-wetting effect is lost.

BACKGROUND

One process for applying to a textile or fabric, liquor such as water-repellent chemicals or dyes that have a low or no affinity for the fibres in the fabric, is known as the padding process. The padding process is an immersion process that consists essentially of two steps. The first step, known as the "dip", is when the fabric is immersed in the required liquid in a padding tank to achieve thorough impregnation of the fabric. The fabric is passed under a submerged roller in the padding tank full of the required liquid, which may be a dye or water-repellent agent.

The second step, known as the "nip", consists of passing the fabric out of the padding tank and then between two rollers, known as pad mangles, to squeeze out air and force liquid into the fibres of the fabric or material. As the fabric passes through the pad mangles, at speeds of up to 50 m per minute, the excess liquid squeezed out is sent back along the fabric. For the process to be effective and even, sufficient liquor needs to be adsorbed on to the fabric before excess is squeezed out by a mangle.

Previous processes for applying a water repellent agent to a fabric in a pad bath have suffered from the problem that the surfactant on and in the fabric inhibited the attainment of good water-repellent properties. One earlier approach to reducing such inhibition was to use a wetting agent that was sensitive to heat and thus rendered non-wetting. This occurs either by evaporation or irreversible decomposition in the heat treatment process applied to the fabric after padding. The products that have been used in the past are the commercially available amine oxide surfactants, such as Cetapol OX20 (Avocet Dyes Ltd), Sulfanole 270 (Omnova Solutions Inc), or volatile surfactants such as Surfynol 61 (Air Products). However, these wetting agents are limited in their ability to provide a strong wetting at low usage levels. Increasing the amounts of wetting agent used merely leads to long periods of heat treatment being needed.

SUMMARY OF INVENTION

A novel combination of reagents has now been found that whilst in solution provide the desired wetting effect to the fabric and on low temperature drying of the fabric continue to provide a re-wetting effect, thus increasing the ability of the fabric to absorb water, but once the wet fabric is raised above a certain temperature the combination no longer has a re-wetting effect.

According to the invention there is provided a wetting system for providing a wetting effect to a fabric or textile comprising a solution of an alkyl polyglucoside (APG) in combination with a solution of a Group 4 metal salt.

Such a wetting system can be applied to fabrics made of natural fibres such as cotton or wool, or to fabrics made of man-made fibres such as polyester or nylon.

DESCRIPTION OF EMBODIMENTS

A wetting agent is a substance that provides the effect of increasing the ability of a liquid to penetrate or spread over the surface of a material such as a fabric or textile cloth. In the padding process, it is typical to use wetting agents in the padding tank or bath to increase the pick-up of the bath liquor and to promote uniformity of absorption. A wetting agent may also be applied to the textile before the immersion in the bath.

The ability of a liquid to spread over the surface of a textile or fabric material or to penetrate the material or fibres making up the material is known as the wetting effect.

The alkyl polyglucoside (APG) acts as the wetting agent and the Group 4 metal salt serves to deactivate the wetting effect of the APG when combined together and heated above a certain temperature.

'In combination' refers to the fact that the solution of APG can be applied to a fabric with, for example, a dye and then the fabric is dried at low temperature, after which the solution of the Group 4 metal salt with, for example, a water repellent treatment is applied to the fabric, after which the fabric is dried at a high temperature, i.e. at least 100° C. Alternatively, the solution of the APG and the solution of the Group 4 metal salt may be applied to the fabric simultaneously.

Each of the two components of the wetting system may be utilised as part of other treatments and still be effective in contributing to the provision of a wetting effect to a fabric. For example the solution of a Group 4 metal salt may form part of a water repellent treatment.

Suitable water repellent treatments include waxes, silicones, stearic acid-melamine based systems, reactive polyurethanes, dendrimer chemistries, hydrophobic alkyl chain fluorinated compounds such as polymers based upon C6 and C8 fluorotelomer-derived acrylates.

Alkyl polyglycosides are a class of non-ionic surfactants derived from sugars and fatty alcohols. When derived from glucose they are known as alkyl polyglucosides. The alkyl polyglucoside has a hydrophilic end to the molecule having a formula $(C_6H_{10}O_5)_n$, where n is at least 1, for example at least 2. In embodiments, n is less or equal to 20. The alkyl polyglucoside also has a hydrophobic end to the molecule comprising an alkyl group, R, typically having from 4 to 20 carbon atoms, preferably from 8 to 16 carbon atoms. In embodiments, the alkyl group may comprise 4 to 6 carbons, 8 to 10 carbons, 8 to 12 carbons, 10 to 12 carbons, 10 to 16 carbons or 16 to 18 carbons. The alkyl polyglucoside can be represented overall by the formula $H(C_6H_{10}O_5)_nOR$:

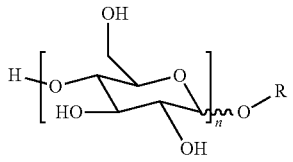

Alkyl polyglucosides are produced by direct synthesis from higher monofunctional alcohols and powdered glucose, in particular anhydrous glucose or glucose monohydrate in the presence of an acid catalyst at an elevated temperature. The reaction chamber is maintained at reduced pressure.

Alkyl polyglucosides are available commercially from The Dow Chemical Company (USA), Seppic SA (France) and BASF (Germany). They are usually available as a solution in water of about 30% w/w or higher. The concentration of the solution of the alkyl polyglucoside used would typically be in the range of 0.1% to 0.5% w/w of the commercially available product.

The Group 4 metal salt preferably comprises a titanium, zirconium or hafnium salt of a carboxylic acid. The carboxylic acid salt may be selected from acetate, acetylacetonate, acrylate, lactate and stearate. The most preferred Group 4 metal salt is zirconium acetate. Suitable salt preparations are available commercially from MEL Chemicals (UK), Dixon Chew (UK) and Dorf-Ketal Chemicals (India).

Zirconium acetate is available as a 22% w/w solution in water and acetic acid.

The ratio of the Group 4 metal salt, preferably zirconium acetate, to the alkyl polyglucoside is preferably in the region of 10:1 to 15:1.

It has now been found that, following the application of the wetting system of the invention to a fabric, if the fabric is dried at a low temperature, i.e. less than 100° C. for example at from 50° C. to 60° C., then the fabric retains the ability to absorb water. In this way the wetting system has a re-wetting effect on the treated fabric.

However, if following the application of the wetting system to a fabric it is dried at a temperature of at least 100° C., i.e. from 100° C. to 160° C., preferably from 100° C. to 140° C., most preferably from 110° C. to 135° C., the ability of the fabric to absorb water, i.e. to be re-wet, is lost.

According to a second aspect of the invention there is provided a process for producing a wetting or re-wetting effect on a textile or fabric comprising applying a wetting system to the fabric that comprises a solution of an alkyl polyglucoside in combination with a solution of a Group 4 metal salt and subsequently drying the fabric at a low temperature, i.e. less than 100° C.

Low temperature drying may be carried out at from 20° C. to 80° C., preferably from 50° C. to 60° C.

The solution of the alkyl polyglucoside and the solution of the Group 4 metal salt may be applied simultaneously to the textile or fabric.

Alternatively, the fabric may be dried at a low temperature after the application of the alkyl polyglucoside solution, and before applying the solution of the Group 4 metal salt.

The fabric may then be dried at a temperature of from 100° C. to 160° C., preferably from 100° C. to 140° C., most preferably from 110° C. to 135° C.

When the solution of the alkyl polyglucoside and the solution of the Group 4 metal salt are applied to the fabric sequentially, the solution of the alkyl polyglucoside may be applied together with a dye in order to colour the fabric. After low temperature drying, the solution of the Group 4 metal salt may be applied to the fabric together with a water repellent treatment, after which the fabric is dried at a temperature of from 100° C. to 160° C.

The advantage of the wetting system of the invention is that at low temperature drying the re-wetting effect is preserved. As a consequence the wetting system does not subsequently inhibit the attainment of good water-repellent properties for the textile or fabric. The water repellent treatment may thus be successfully applied to the fabric in the pad tank or bath.

The present invention will be further described by way of reference to the following examples.

Example 1

A solution comprising of 5 g of a mixture of alkyl polyglucosides based on natural fatty alcohol C12-C14 (Glucopon 600 CUSP, BASF Chemicals) and 5 g of Titanium Lactate (ammonium salt)(Tyzor LA, Dorf Ketal) in distilled water (1000 g) was used as a bath solution to apply the water repellent Texfin WR-NF (Textile Chemicals) to a sample of polyester microfiber (weight of 120 g/m$^2$) using a Mathis HVF350 Laboratory Padder.

The Texfin WR-NF was introduced to the bath solution at a level of 200 g/l and the pH was adjusted to a range of 4 to 5 using acetic acid at a level of 0.5 to 1.0 g/l. The fabric was passed through the final bath solution at a rate of 4 metres per minute and passed through the mangle at a nip pressure of 4 bar. The pickup of the fabric was measured to be 56% of its dry weight.

The fabric was dried in an oven at 130° C. for a period of 3 minutes. Assessment with the ISO 4920:2012 Textile fabrics, determination of resistance to surface wetting (spray test), gave a result of ISO 3, indicating successful application of the water repellent.

Example 2

An oil in water macroemulsion was prepared using 220 g of polydimethylsiloxane, viscosity 100 centistoke (Dow Corning 200 Fluid, 100 CST) as the oil phase (22% w/w) and a mixture of 44 g C8 to C16 fatty alcohol glucoside (Plantacare 818UP, BASF Chemicals) in 736 g deionised water. The emulsion was produced by mechanical means using a laboratory high shear mixer operating at 21,000 rpm and the resultant oil droplet size in the emulsion was below 7 microns.

The emulsion was further diluted in deionised water at a ratio of 1 part emulsion to 4 parts water. A sample of lightweight polyamide microfiber fabric (weight 75 g/m$^2$) was fully immersed in the diluted emulsion for a period of ten minutes. After this, zirconium acetate (22% solution, Mel Chemicals) and acetic acid (80% technical grade) were added at a rate of 1.25% and 2.5% of the solution weight, respectively. The fabric was left immersed for a further ten minutes before removing and allowing to drip dry, i.e. at <100° C.

Assessment of the dried fabric was carried out by dipping the fabric into water. It was found to become immediately saturated. The fabric was then heated using a domestic iron at a heat setting of approximately 120° to 130° C. The duration of heat treatment was between 1 and 2 minutes. After heat treatment, the fabric was assessed by dipping into water, whereby it was found that an immersion time of over 10 minutes was required for the fabric to become saturated.

The invention claimed is:

1. A wetting system for providing a wetting effect to a fabric or textile, the system comprising a solution of an alkyl polyglucoside (APG) in combination with a solution of a Group 4 metal salt, wherein the Group 4 metal is selected from the group consisting of titanium, zirconium and hafnium and the salt is a carboxylic acid salt selected from the group consisting of acetate, acetylacetonate, acrylate and lactate.

2. The wetting system according to claim 1, wherein the alkyl polyglucoside comprises a hydrophilic end to the molecule with a formula $(C_6H_{10}O_5)_n$, where n is at least 1, and a hydrophobic end to the molecule comprising an alkyl group having from 4 to 20 carbon atoms.

3. The wetting system according to claim 1, wherein the Group 4 metal salt is zirconium acetate.

4. The wetting system according to claim 1, wherein the Group 4 metal salt forms part of a water repellent treatment.

5. The wetting system according to claim 4, wherein the water repellent treatment is selected from the group consisting of waxes, silicones, stearic acid—melamine based systems, reactive polyurethanes, dendrimer chemistries, and hydrophobic alkyl chain fluorinated compounds.

6. The wetting system according to claim 2, wherein the Group 4 metal salt is zirconium acetate.

7. The wetting system according to claim 2, wherein the Group 4 metal salt forms part of a water repellent treatment.

8. The wetting system according to claim 3, wherein the Group 4 metal salt forms part of a water repellent treatment.

9. The wetting system according to claim 7, wherein the water repellent treatment is selected from the group consisting of waxes, silicones, stearic acid—melamine based systems, reactive polyurethanes, dendrimer chemistries, and hydrophobic alkyl chain fluorinated compounds.

10. The wetting system according to claim 8, wherein the water repellent treatment is selected from the group consisting of waxes, silicones, stearic acid—melamine based systems, reactive polyurethanes, dendrimer chemistries, and hydrophobic alkyl chain fluorinated compounds.

11. The wetting system according to claim 1, wherein the alkyl polyglucoside comprises a hydrophilic end to the molecule with a formula $(C_6H_{10}O_5)_n$, where n is at least 1, and a hydrophobic end to the molecule comprising an alkyl group having from 8 to 16 carbon atoms.

12. The wetting system according to claim 5, wherein the hydrophobic alkyl chain fluorinated compounds are polymers based upon C6 and C8 fluorotelomer-derived acrylates.

13. The wetting system according to claim 9, wherein the hydrophobic alkyl chain fluorinated compounds are polymers based upon C6 and C8 fluorotelomer-derived acrylates.

14. The wetting system according to claim 10, wherein the hydrophobic alkyl chain fluorinated compounds are polymers based upon C6 and C8 fluorotelomer-derived acrylates.

15. A process for producing a wetting or re-wetting effect on a textile or fabric comprising applying a wetting system to the fabric that comprises a solution of an alkyl polyglucoside in combination with a solution of a Group 4 metal salt and drying the fabric at a low temperature, of less than 100° C., wherein the Group 4 metal is selected from the group consisting of titanium, zirconium and hafnium and the salt is a carboxylic acid salt selected from the group consisting of acetate, acetylacetonate, acrylate and lactate.

16. The process according to claim 15, wherein the solution of the alkyl polyglucoside and the solution of the Group 4 metal salt are applied simultaneously to the textile or fabric.

17. The process according to claim 15, wherein the fabric is dried at a low temperature after the application of the alkyl polyglucoside solution and before the solution of the Group 4 metal salt is applied to the fabric.

18. The process according to claim 17, wherein after the application of the Group 4 metal salt the fabric is dried at a temperature of from 100° C. to 160° C.

19. The process according to claim 17, wherein the solution of the alkyl polyglucoside is applied to the fabric together with a dye and the solution of the Group 4 metal salt forms part of a water repellent treatment.

20. The process according to claim 18, wherein the solution of the alkyl polyglucoside is applied to the fabric together with a dye and the solution of the Group 4 metal salt forms part of a water repellent treatment.

21. The process according to claim 18, wherein after the application of the Group 4 metal salt the fabric is dried at a temperature of from 100° C. to 140° C.

22. The process according to claim 21, wherein after the application of the Group 4 metal salt the fabric is dried at a temperature of from 110° C. to 135° C.

* * * * *